United States Patent [19]

Hatala

[11] 4,125,172

[45] Nov. 14, 1978

[54] EMERGENCY ESCAPE APPARATUS

[76] Inventor: Walter Hatala, 3905 Ivy St., East Chicago, Ind. 46312

[21] Appl. No.: 872,302

[22] Filed: Jan. 25, 1978

[51] Int. Cl.[2] ..... A62B 1/02; B66B 9/00

[52] U.S. Cl. ..... 182/19; 182/3; 182/36; 182/82

[58] Field of Search ..... 182/3, 48, 82, 12, 19, 182/36, 42, 141; 187/6

[56] References Cited

U.S. PATENT DOCUMENTS

| | | | |
|---|---|---|---|
| 308,444 | 11/1884 | Terwilliger | 182/82 |
| 607,161 | 7/1898 | Conaway | 182/82 |
| 3,831,711 | 8/1974 | Smith | 182/82 |
| 3,944,021 | 3/1976 | Smith, Jr. | 182/3 |

*Primary Examiner*—Reinaldo P. Machado
*Attorney, Agent, or Firm*—Walter Leuca

[57] ABSTRACT

A riding emergency or fire escape apparatus mountable interior of a building for delivering an inhabitant exterior of the building for free fall descent to the ground. The apparatus of this invention exterior of the building essentially comprises plate members mounted in a recess provided in the wall of the building or spaced from the wall of the building a few inches so as not to detract from the architecture of the building. A base plate is provided with a vertically extending zig-zag track. A cover plate overlaying and planularly spaced from the base plate is formed with a vertically extending lineal track. The passenger transport mechanism is provided with a chair and is mountable interior of the building. Similarly arranged base and cover plates containing zig-zag tracks and lineal tracks respectively, are provided at each floor level interior of the building. The tracks of the respective plates align with the corresponding tracks in the fire escape structure exterior of the building through an openable door at each floor level. The passenger transport mechanisms stored at each floor level, comprise a chair connected to a vertically disposed roller trolley frame which is provided with rollers which ride the zig-zag track for a slowed down free fall descent while a second roller rides in the vertical track so that the passenger chair is restrained to a lineal vertical descent.

20 Claims, 13 Drawing Figures

EMERGENCY ESCAPE APPARATUS

BACKGROUND OF THE INVENTION

1. Field of the Invention

This invention relates generally to fire or emergency escape apparatus and more particularly to riding emergency escape apparatus.

2. Description of the Prior Art

Exterior fire or emergency escape apparatus of the prior art for multi-story buildings are generally ladder or step and platform steel structures fixed to the exterior of the building to be served. Such fire escape structures not only are unbecoming and architecturally incompatible with the building exterior but are dangerous to use because they are difficult to get to, usually requiring a window to be opened and climbed out of, and because of exposure to the elements such as rain, ice, snow and cold making secure descent difficult. These disadvantages coupled with the usual panic attending an emergency such as fire, as well as height, visibility of height plus danger of tripping makes such fire escapes very undesirable. Also, riding fire escapes of the prior art that I am aware of have electric drive means which may malfunction.

SUMMARY OF THE INVENTION

This invention overcomes all of the above disadvantages of the prior art fire escapes by providing an escape apparatus which may be mounted on a building so that its projection from the building wall is minimal. In addition, the passenger transport mechanism of this invention is movable by gravity from the interior of the building at a preselect station where the seats are mounted. Motion is initiated by gravity and the riding passenger descends free fall to safety. The passenger transport mechanism, not being otherwise restrained in its gravity fall other than by friction on a zig-zag track vertically disposed, will descend safely since the passenger transport mechanism will follow the total zig-zag distance of the track thereby requiring the passenger transport mechanism to reach the vertical distance of the fire escape in the same time that it takes the passenger transport mechanism to travel the total length of the zig-zag track since the force of gravity acts on the passenger transport mechanism whether the path is vertical or zig-zag. Therefore, the time of vertical descent will be much more than vertical free-fall time even though there are no cables or other restrictive means for restraining the descent of the passenger transport mechanism thereby accomplishing a safe descent.

Another important characteristic of this invention is the fact that its structure, though relatively wide and as high as the building stories it is intended to reach or service, its thickness or depth is minimal, that is, on the order of a few inches. The exterior structure thereof projects from the wall of the building or even made flush with the wall of the building by providing a recess in the wall of the building and therefore may be made to blend with the architecture of the building. The emergency escape apparatus of this invention may be mounted by the user inside the building and when secured in the seat provided then exits the building for descent. Further, the escape apparatus of this invention operates by gravity and does not require electric motor drive means which may fail and thereby leave the inhabitants of the building stranded.

Other objects and advantages of this invention will become more apparent after a more careful study of the following detailed description taken with the accompanying drawings wherein is illustrated the preferred embodiment of this invention.

DESCRIPTION OF THE PREFERRED EMBODIMENT

Figure 1:
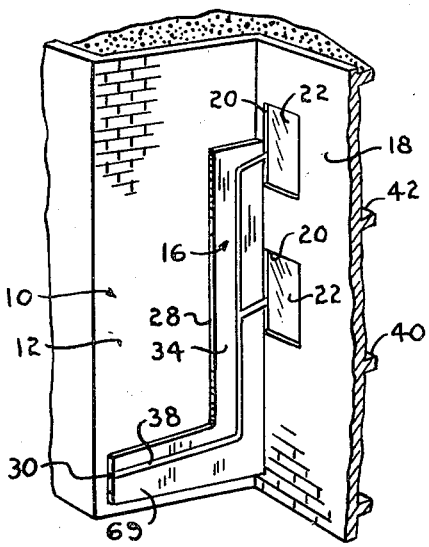
FIG. 1 is a perspective view of the emergency escape apparatus of this invention shown attached to a building wall which is shown in fragment.
Figure 2:
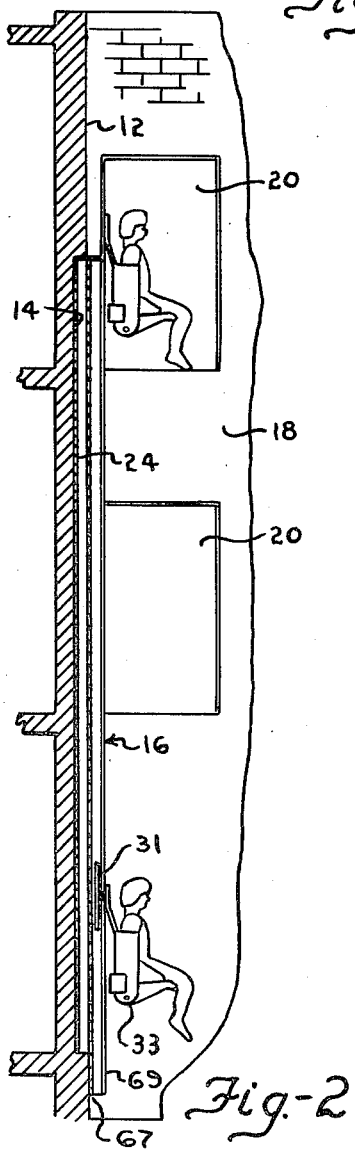
FIG. 2 is a side elevation of this invention shown carrying occupants.
Figure 3:
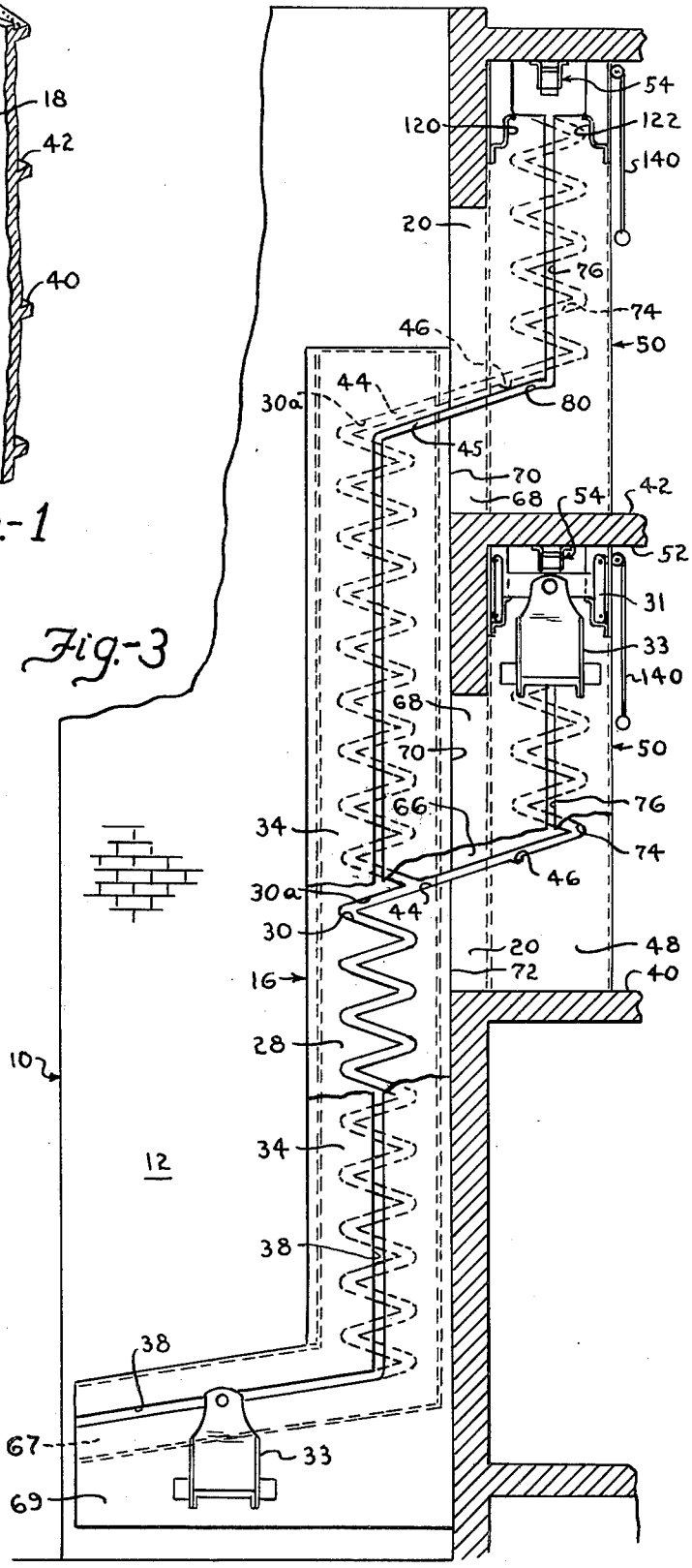
FIG. 3 is a front elevation of this invention showing a part thereof broken away and showing the building to which it is connected in fragment and in section.

Referring now more particularly to the accompanying drawings and for the present FIGS. 1 through 3, in which like numerals indicate like parts throughout the several views, numeral 10 designates a multi-story building having side walls 12 on which is mounted thereagainst or in a recess 14 provided therein, the fire escape apparatus 16 of this invention. At each floor level in wall 18 forming a corner juncture with side wall 12, are door openings 20 and doors 22 for communicating the interior of building 10 with the exterior thereof.

Figure 5:
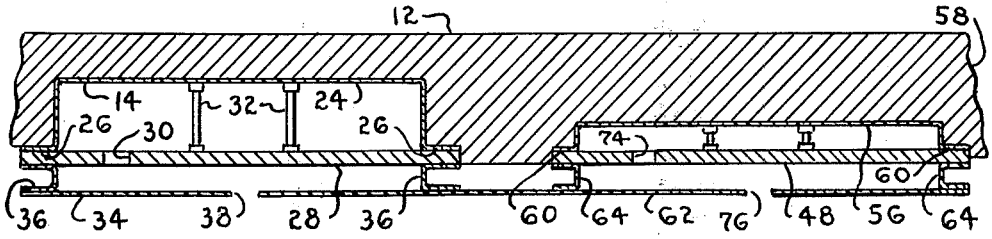
FIG. 5 is a cross sectioned view taken along lines 5—5 of FIG. 4.
Figure 10:
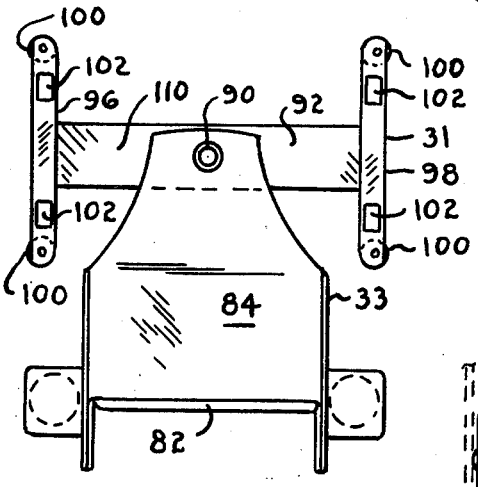
FIG. 10 is a front view of the trolley and seat apparatus.
Figure 11:
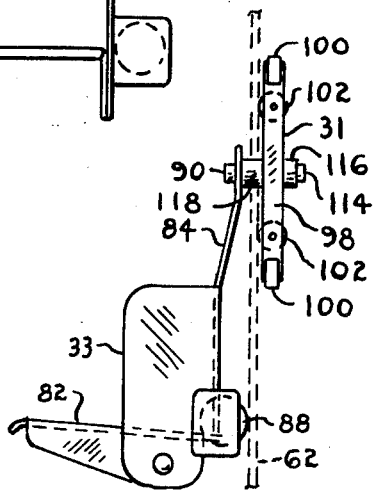
FIG. 11 is a side view thereof.
Figure 12:
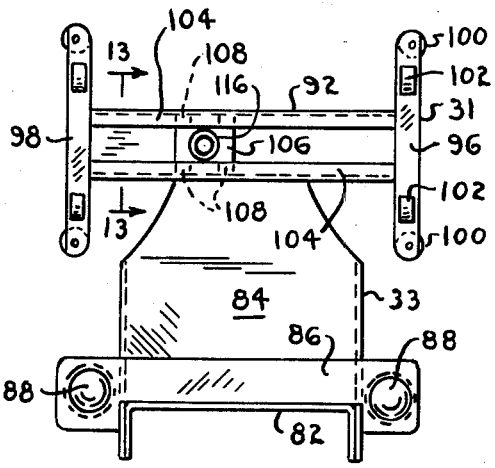
FIG. 12 is a back view thereof.

As best illustrated in FIGS. 3 and 5, the exterior structure of emergency escape apparatus 16 of this invention is comprised of a frame member such as base plate 24, supported in recess 14 in building side wall 12 by means of bolts or other conventional means. Plate 24 is provided with side flanges 26 for overlapping the masonry face of wall 12 at the edges of recess 14 and also serve to provide side edges for seating the sides of an elongated structural member such as trolley track plate 28 for securement thereto. Track plate 28 is formed with a continuous zig-zag track or slot 30 the vertical height thereof which serves as the descent track for the trolley device 31 to which is connected an escape chair 33 (FIGS. 10 through 12). Spacer rods 32, as more clearly shown in FIG. 5, serve to rigidly support the portions of trolley track plate 28 longitudinally separated by zig-zag slot 30 throughout its length. A second elongated structural member such as guide track plate 34 overlaps trolley track plate 28 and is planularly spaced therefrom by means of vertically disposed side channels 36 through which connection is made by any convenient means to track plate 28 and ultimately to building wall 12. Guide plate 34 is formed with a vertically disposed linear guide track or slot 38. Slot 38 of plate 34 is positioned centrally of the lateral departures of zig-zag slot 30 and extends transversely thereof. At the ground level of building 10, as more clearly shown in FIGS. 1 and 3, trolley track plate 28 and guide plate 34 together with their respective tracks 30 and 38, extend horizontally to a landing discharge position sufficiently distant from the guide track 38 of cover plate 34 for a gently sloped discharge travel. It is to be understood, of course, as a matter of practical construction, that all longitudinally extensive plates and channels throughout the structure of this invention are constructed from a series of plates and channels which are aligned end to end to form the overall plates and channels.

At each building floor level as at 40 and 42, trolley track plate 28 is laterally slotted as at 44 to form a continuation of segment 30*a* of zig-zag track 30 to the edge thereof. Tracks or slot 44 are aligned with tracks or slots 46 and formed in trolley track plate 48 on chair storage and mounting area 50 which forms a part of the interior structure of the escape apparatus 16 of this invention. As more clearly illustrated in FIGS. 3 through 5, the underside of a floor level such as 42, forms the ceiling 52 of floor level 40 therebelow. Chair storage area 50 includes a chair and trolley advancing apparatus 54 and a second base plate 56 mounted against interior wall 58. Base plate 56 is similar in structure to base plate 24 in that it is formed with side flanges 60 for overlapping the edges of the wall and against which interior trolley track plate 48 overlaps and is similarly connected thereto and spaced therefrom. Overlapping trolley track plate 48 is guide plate 62 spaced therefrom by vertically disposed side channels 64 through which conventional means supportively connect the interior structure of this apparatus to the interior wall 58. This second set of trolley track plate 48 and guide plate 62 extends vertically between floor levels 40 and 42 interior of the building and are formed to project laterally as at 66, 68, respectively, through the escape door opening 20 to contiguously abut against side edges 70, 72 of exterior trolley track plate 28 and guide plate 34 respectively, on exterior wall 12. Trolley track plate 48 and guide track plate 62 are similarly provided with a zig-zag slot 74 and vertical linear guide slot 76, respectively, the discharge ends 46 and 80 thereof, respectively, are formed to laterally slope to align with slot 44 of exterior trolley track plate 28 and slot 45 of exterior cover plate 34 so that the travel of the trolley device 31 and chair 33 may proceed from their storage position to the mounting station at the building floor levels illustrated such as 40 and 42 and thence continue through the escape openings 20 to the exterior portion of the escape apparatus of this invention. I have chosen to show the tracks in the form of slots formed in the plates for illustrative purposes. It should be understood, however, that tracks may be formed otherwise such as channel bars.

Figure 13:
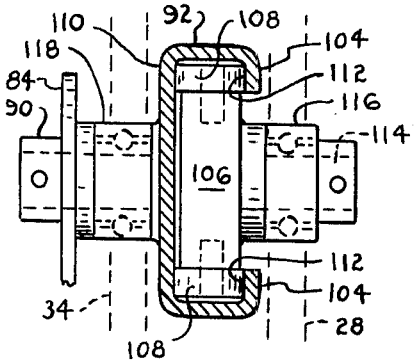
FIG. 13 is an enlarged section of the trolley device taken along lines 13—13 of FIG. 12.

With reference to FIGS. 8 through 12, escape chair 33 is preferably provided with a hinged seat 82 to maximize storage capacity when not in use. Chair back 84 is provided with a cross bar 86, the ends of which having mounted in sockets provided therein, roller balls 88 for free universal rolling movement against trolley plates 48 and 28. Chair back 84 is pivotally connected as at 90 to horizontal channel bar 92 of trolley device 31. Trolley device 31 comprises cross or horizontal channel bar 92 provided with elongated or vertical stabilizer end members 96 and 98 at opposite ends of and normal to channel bar 92. Stabilizer members 96 and 98 are further each provided with a pair of side bearing rollers 100 and 102, respectively, at each distal end thereof. As shown in FIG. 13, the top and bottom flanges 104 of channel bar 92 serve as a guideway for trolley block 106 which freely moves the length of channel bar 92. To facilitate such free movement, trolley block 106 is provided with rollers 108 which roll against either web 110 or flanges 104 of the channel bar 92 during the to and fro movement of trolley block 106. Trolley block 106 is further centrally provided with shaft 114 on which is journaled roller 116 which is adapted dimension-wise to ride in slots 74 and 30 of trolley track plates 48 and 28 respectively. Chair back 84 is pivotally connected to shaft 90 which is centrally fixed to the web 110 of channel bar 92. Chair back 84 is spaced from web 110 to accommodate roller 118 journaled on shaft 90 therebetween. Roller 118 is adapted to ride down guide slots 76 and 38 of guide plates 62 and 34 respectively.

Figure 7:
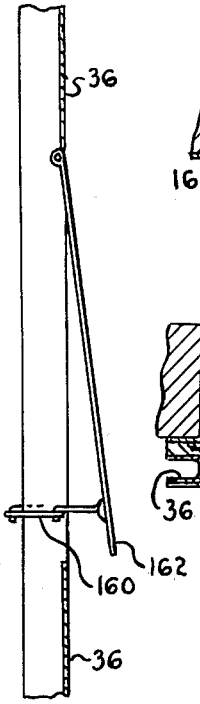
FIG. 7 is a detail elevation of the lever means which operates the escape door lock sectioned along lines 7—7 of FIG. 6.
Figure 9:
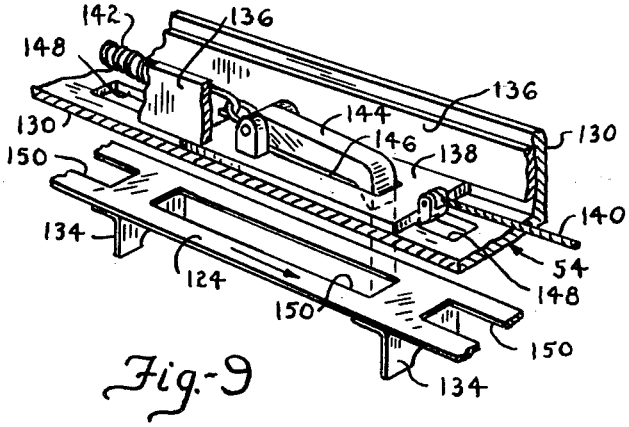
FIG. 9 is a perspective detail view of the pull device for advancing the trolley and seat apparatus from storage position to the mounting position.
Figure 8:
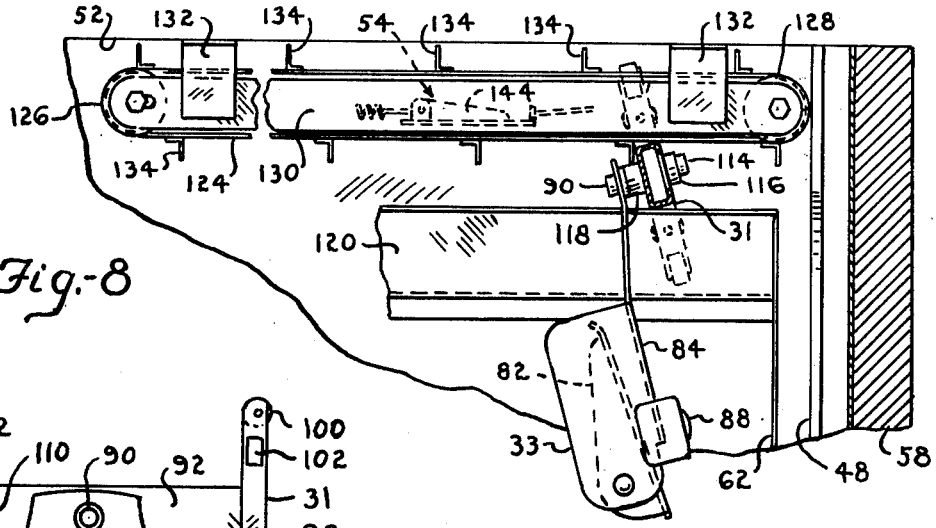
FIG. 8 is a side view of the seat storage and advancing mechanism in the interior of the building above the mounting area.

With reference to FIGS. 7, 8 and 9, the chair storage area 50 includes side wall well members 120 and 122 supported longitudinally directed toward trolley track plate 48 and guide track plate 62, and on opposite side walls spaced down from ceiling 52 of each floor. Side wall well members 120 and 122 provide guide means as well as support and storage means for the vertical stabilizer members 96 and 98 of the trolley devices 31 which are stacked back to back as close together as chairs 82, connected to the trolley devices, allow when folded out of the way. Trolley devices 31 are each advanced toward wall 58 where they are successively dropped between guide track plate 62 and trolley track plate 48 to initiate its gravity descent, the velocity of the fall being retarded by the zig-zag travel of the trolley block 106 in zig-zag slot 74, to the building floor levels where they may be mounted preparatory for escape decent. Chair advancing apparatus 54 comprises, as better shown in FIGS. 8 and 9, an endless belt means 124 mounted on end wheels 126, 128 which are supported at the end of a frame structure 130. Frame structure 130 is supported in any convenient manner such as by brackets 132 from the ceiling wall such as 52 of each floor level. Endless belt means 124 is provided with pusher plates 134 spaced therearound. Chair advancing apparatus frame structure 130 is spaced from the ceiling so that pusher plate 134 engages the top edge of horizontal channel bar 92 of trolley device 31. As further shown in FIG. 9, frame structure 130 includes guide means 136 on which is mounted a slide plate 138 slidable to and fro in guide means 136 in response to a pull on cord 140 connected to the forward end of the slide plate 138 and the return bias of spring means 142 connected to the rear of the slide plate. Slide plate 138 has mounted thereon a pivoted pawl lever 144, the distal end thereof being angled downward which extends through slotted openings 146, 148 and 150 provided respectively, in slide plate 138, guide means 136 and endless belt 124 for making contact with the forward edge of a slotted opening 150 in endless belt 124 between adjacent pairs of pusher plates 134. Cord 140 as shown in FIG. 3 is manually pulled to move slide plate 138 forward in guide means 136 against the bias of spring 142 which is anchored to the frame structure 130 thereby causing pawl lever 144 to engage the forward end of the slotted opening 150 in endless belt 124 and thereby longitudinally move the belt from which are suspended pusher plates 134 which engage and move the stacked trolley devices 31 forward. To continue the motions of the endless belt so that succeeding trolley devices are advanced, the tension on cord 140 is released allowing the bias of spring 142 to return slide plate 138 until pawl lever 144 lifts out of one slot 124 and drops in a following slot 124 preparatory to succeeding forward motions and continuation of pushing trolley devices 31 for deposit between base plate 48 and the cover plate 62 interior of the building.

Figure 6:
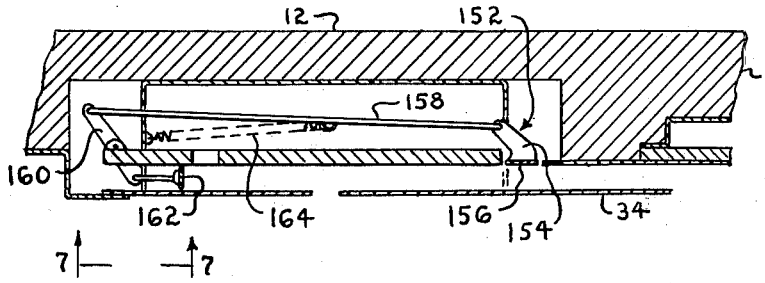
FIG. 6 is a cross sectional view of this invention taken along lines 6—6 of FIG. 4.
Figure 4:
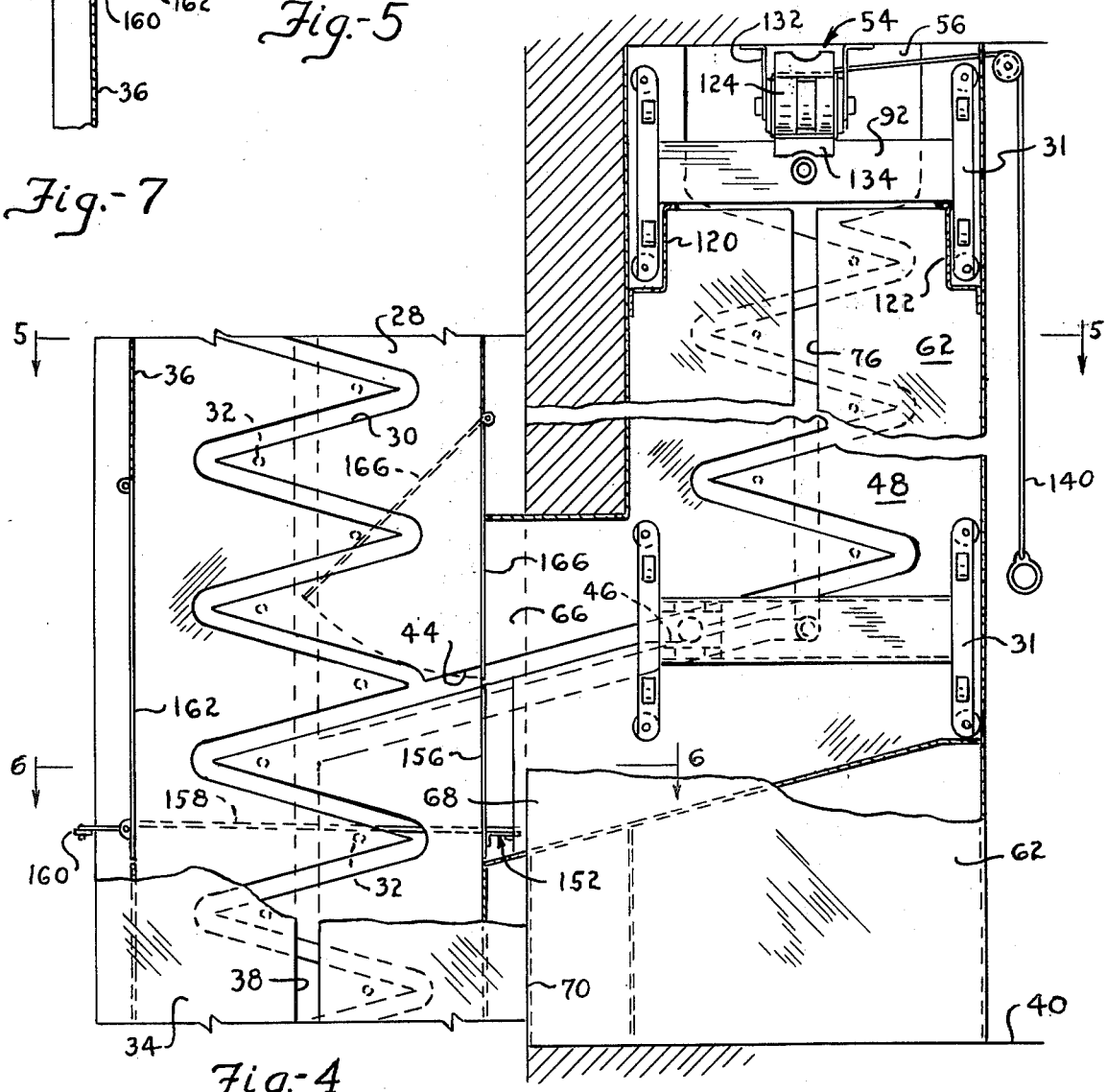
FIG. 4 is a side view of the escape door opening showing the escape seat mounting area interior of the building and the path thereof to the exterior of the building.

As more clearly shown in FIGS. 4, 6 and 7, the mounting of the escape chair 33 at floor level 40 for example, initiates gravity movement of the trolley device and chair combination to follow slotted tracks 46 and 80 in trolley track plate 48 and guide plate 62 respectively, through door opening 20 by manually opening door 20 while seated in the chair. Additional slot tracks 46 and 80 in the trolley and guide plate extensions 66 and 68 which abut against trolley plate 28 and guide plate 34 respectively of the apparatus of this invention exterior of the building lineally aligned with their corresponding additional slotted track segments 30 and 38 will allow the transfer of the trolley device chair combination from the mounting station interior of the building to the emergency escape apparatus exterior of the building to continue its descent to the ground.

As illustrated in FIGS. 4, 6 and 8, a lock means 152 is provided for each escape door 22. Door lock means 152 comprises a lock lever 154 supported in the building wall for pivotal movement. Lock lever 154 is formed with a lock element 156 which when pivoted moves into the space between trolley track plate 28 and guide track plate 134 in slotted track 44 thereby blocking the travel of trolley device 31. This action may also be connected to door 22 preventing opening of the door. Lock lever 154 is activated to pivot its locking element 156 to stop the declining travel of trolley device 31 and to lock door 22 by transverse link 158 connecting the end of lock lever 154 and pivot lever 160. Pivot lever 160 is activated by hinged bar 162 being a segment of side channels 36. Lock means 152 is provided out of the way in recesses provided in wall 12 at each floor level and behind trolley track plate 28. Spring means 164 shown in dotted lines serves to keep lock lever 154 in open position which causes the hinged bar 162 to extend inward interrupting the vertical side track so that when a descending trolley device 31 engages the hinged bar 162 situated at any floor level, it pushes the hinged bar to alignment with the vertical run of side channels 36. This action moves link 158 causing lock lever 154 to pivot and block the travel of trolley device 31 and simultaneously locks door 22 shut at any of the floor levels. The purpose of this apparatus is to prevent the escape chair exiting from the interior of the building while another escape chair is descending on the exterior structure of this invention and is in close proximity with the exit door so controlled to avoid collisions. Obviously, each hinged bar member 162 forming a segment of the side track of side channel 136 is at a level above its respective floor level so that when a descending trolley device engages a hinged bar member, the locking action will occur sufficiently in advance to prevent an interior trolley device from exiting through the escape door.

A second brake mechanism shown in FIG. 4 is provided on side channel 36 opposite side channel 36 provided with hinge bar 162. It comprises a second hinged bar 166 which is also a segment of side channel 36 provided in the space between guide track plate 34 and trolley track plate 28. It also forms a part of the side track and is activated to pivot away from the vertical by the exiting of the interior trolley device 31 as the trolley device enters the zig-zag pattern of exterior descent. Upon clearance by trolley device 31 of hinged bar 166, it will return to its vertical position by gravity. The purpose of this second brake mechanism is to block the downward travel of another descending trolley device which has not reached the hinged bar 162 to activate the locking means 152, as a consequence of which an interior trolley device 31 has entered the exterior descent structure of this invention.

In the operation of this invention, escape chair storage and mounting area 50, interior of the building, is entered at any floor level, when the occassion arises that it is necessary to escape the building. By manually pulling on cord 140, chair advancing apparatus 54 will operate to deposit a trolley device 31 and chair 33 combination from its storage wells 120, 122 into the space between guide track plate 62 and trolley track plate 48. The trolley device and connecting chair descends by gravity in the slotted track provided therein to the floor level. The occupant secures himself in the chair and initiates movement by slight manual effort down the incline of slots 46 and 80 to open escape door 22 and thereby continue onto slotted tracks 44 and 45 of base plate 28 and guide plate 34, respectively, exterior of the building. As shown in FIGS. 1 and 2, when the escape chair and occupant reach ground level, respective slotted tracks 30 and 38 in trolley track plate 28 and guide track plate 34 which extend laterally as at 67 and 69, respectively, causes the chair to move in a substantially horizontal direction at a reduced speed allowing the occupant to dismount on the ground and remove the trolley device and chair combination from the apparatus of this invention to allow succeeding escape chairs and occupants to similarly dismount. Trolley devices and chair combinations are retrieved and restored in the storage wells of each floor level after the emergency which occasioned the escape activity has been remedied preparatory for future emergency use.

I claim:

1. An emergency escape apparatus for a multi-floor level building having escape openings at said floor levels of said building, comprising:

a zig-zag track means vertically extensive of said multifloor levels;

a rectilineal guide means transversely extensive of said zig-zag track means, supported planularly spaced therefrom;

means connecting said track means and said guide means to an exterior wall of said building adjacent said escape openings;

a trolley device supported in said track means for zig-zag movement; and a body support means connected to said trolley device, said body support means restrained from moving zig-zag by said rectilineal guide means.

2. The emergency escape apparatus of claim 1 wherein said trolley device is further characterized as movable between said zig-zag track means and said rectilineal guide means.

3. The emergency escape apparatus of claim 2 wherein said rectilineal guide means is further characterized as extending between said trolley device and said body support means.

4. The emergency escape apparatus of claim 3 wherein said trolley device is further characterized as having means movable in said zig-zag track means and having means for supporting said body support means, movable in said rectilineal guide means.

5. An emergency escape apparatus for a multi-floor level building having escape openings at said floor levels of said building, comprising:

a zig-zag track means vertically extensive of said multifloor levels;

a rectilineal guide means transversely extensive of the zig-zag direction of said track means, supported planularly spaced therefrom;

a vertical track means disposed on each side of said zig-zag track means between said track means and said rectilineal guide means;

means connecting said track means, said guide means and said vertical track means to an exterior wall of said building adjacent said escape openings;

a trolley device having means movable in said zig-zag track means and having end means movable on said vertical track means; and a body support means connected to said trolley device, said body support means restrained from moving zig-zag by said rectilineal guide means.

6. The emergency escape apparatus of claim 5 wherein said trolley device is further characterized as movable between said zig-zag track means and said rectilineal guide means.

7. The emergency escape apparatus of claim 6 wherein said rectilineal guide means is further characterized as planularly supported between said trolley device and said body support means.

8. An emergency escape apparatus for a multi-floor level building having escape openings at said floor levels of said building, comprising:

an alternately directed declining track means;

vertical track means on each side of said alternately directed declining track means;

a rectilineal guide means centrally and transversely disposed relative to said first mentioned track means planularly spaced therefrom;

means connecting said first and second mentioned track means and said guide means to the exterior wall of said building adjacent said escape openings;

a trolley device having first and second means movable on said first mentioned track means and said vertical track means;

another means fixed on said trolley device;

a body support means connected to said another means fixed to said trolley device;

said first means on said trolley device movable on said first mentioned track means being movable on said trolley device; and said second means on said trolley device movable on said vertical track means and said another means on said trolley device movable in said rectilineal guide means for maintaining said trolley device and said body support means in rectilineally declining movement.

9. The emergency escape apparatus of claim 8 wherein said first means on said trolley device movable on said first mentioned track means is further characterized as being movable on said trolley device.

10. An emergency escape apparatus for a multi-floor level building having escape openings at said floor levels of said building, comprising:

an elongated structural member vertically disposed against an exterior wall of said building, said elongated structural member being formed with a series of alternately declining track segments to provide a resultant vertical descent, said elongated structural member having an additional track segment extending from each of said escape openings to a declining track segment in declining alignment therewith;

a second elongated structural member vertically and laterally extensive with said first elongated structural member supported in planular spaced relation thereto, said second elongated structural member having a vertically disposed guide means centrally and transversely positioned relative to said track segments;

vertical track means on each side of said alternately declining track segments;

means for connecting said first and second elongated structural member and said vertical track means to an exterior wall of said building adjacent said escape openings;

a third elongated structural member vertically disposed against an interior wall of said building between said floor levels, said third elongated structural member formed with a series of alternately declining track segments to provide a resultant vertical descent, said third structural member having an additional track segment extending from one of said alternately declining track segments therein to said escape opening in declining alignment with said track segment and said additional track segment in said first mentioned elongated structural member;

a fourth elongated structural member vertically and laterally extensive with said third elongated structural member supported planularly spaced therefrom, said fourth elongated structural member having a vertically disposed guide means centrally and transversely positioned relative to said alternately declining track segments in said third elongated structural member;

an additional guide means in said fourth elongated structural member extending from said vertical guide means therein to said escape opening in declining alignment with said additional guide means in said second elongated structural means;

a second vertical track means on each side of said alternately declining track segments on said third mentioned elongated structural members;

means for connecting said third and fourth elongated structural members and said vertical track means to an interior wall of said building between said floor levels adjacent said escape opening;

a trolley device movable between said third and fourth mentioned elongated structural members and said first and second mentioned elongated structural members, said trolley device having a trolley block movable across said trolley device and said alternately declining track segments of either of said first and third elongated structural members, said trolley device having end means movable on either of said second and first vertical track means associated with said third and first mentioned elongated structural members, and said trolley device having a fixed means extending through and movable in said vertical guide means and said additional guide means in said fourth and second elongated structural members; and a body support means connected to said fixed means of said trolley device.

11. The emergency escape apparatus of claim 10 wherein one of said first vertical track means is further characterized as having lever means activated by said end means of said trolley device to block said additional track segment of said third mentioned elongated structural member at said escape opening.

12. The emergency escape apparatus of claim 11 wherein said other of said first vertical track means is further characterized as having a lever movable by a trolley device movable in said additional track segment of said third elongated structural member to interrupt said first vertical track means to block the descent of another trolley device in said first vertical track means.

13. A trolley device for an emergency escape apparatus, comprising:

a cross channel bar;

longitudinal members fixed to the distal ends of said cross channel bar normal thereto;

a trolley block member movable the length of said cross channel bar, said trolley block having shaft means projecting therefrom, and roller means on said shaft means;

a second shaft means fixed to said cross channel bar projecting oppositely from said shaft means on said trolley block; and a body support means connected to said second shaft means.

14. The trolley device of claim 13 wherein said trolley block is further characterized as having rollers to provide roller contact between said trolley block and said cross channel bar, and wherein said second shaft means is further characterized as having a roller member journaled thereon.

15. The trolley device of claim 14 wherein said elongated members are further characterized as having roller members at the distal ends thereof.

16. The trolley device of claim 15 wherein said body support means is further characterized as being a chair having a back and a hinged seat.

17. The trolley device of claim 16 wherein said chair is further characterized as having rollers laterally projecting therefrom.

18. A trolley device storage and advancing apparatus for depositing a trolley device in a track system of an emergency escape apparatus, wherein said trolley device comprises a horizontal cross member and elongated vertical members at the distal ends of said cross member, comprising:

longitudinal well means laterally spaced to support the elongated vertical members of a plurality of trolley devices in stacked relation, the distal end of said longitudinal well means being adjacent said track system;

longitudinal frame supported vertically spaced from and between said laterally spaced well structures, said longitudinal frame having fore and aft rollers at the longitudinal distal ends thereof;

an endless belt over said rollers and said longitudinal frame;

pusher bars fixed to said endless belt regularly spaced therearound and projecting outwardly therefrom for engaging said cross bar of any of said plurality of trolley devices for moving said trolley devices toward said track system; and motive means for moving said endless belt.

19. The storage and advancing apparatus of claim 18 wherein said motive means is further characterized as being a hinged pawl lever longitudinally movable on said frame, said pawl lever being pivotable to releasably engage said endless belt for moving said endless belt in one direction.

20. An emergency escape apparatus for a multi-floor level building having escape openings at said floor levels of said building comprising the combination of:

a zig-zag track means vertically extensive of said multi-floor levels, and rectilineal guide means transversely extensive of said zig-zag track means supported planularly spaced therefrom, said zig-zag track means and rectilineal guide means being connected to the exterior of said building adjacent said escape openings;

a second zig-zag track means and a second rectilineal guide means transversely extensive of said second zig-zag track means vertically extensive between each floor level interior of said building adjacent said escape openings;

additional track means on said first and second zig-zag track means communicating said first and second zig-zag track at said escape opening, and additional track means on said first and second rectilineal guide means communicating said rectilineal guides therein at said escape opening;

a trolley device having means movable in said zig-zag track means and said additional track means, and having a second means simultaneously movable in said rectilineal guide means and said additional guide means, and a body support means connected to said second means thereof;

lock means for blocking the travel of said trolley device in said track means;

means for storing a plurality of said trolley devices, said means having an end for discharging said trolley devices adjacent said second zig-zag track means and said second rectilineal guide means; and means for advancing said trolley device to said discharge end of said storage means for depositing said trolley device in said second track and guide means.

* * * * *